United States Patent [19]

Sanchez-Robles et al.

[11] Patent Number: 4,874,131

[45] Date of Patent: Oct. 17, 1989

[54] COLOR DOSIFICATION/APPLICAION MACHINE

[76] Inventors: Francisco B. Sanchez-Robles; Maria De La Paloma M. Manterola, both of C/Calixto III no. 51 32a, 46008 Valencia, Spain

[21] Appl. No.: 51,643

[22] Filed: May 20, 1987

[30] Foreign Application Priority Data

May 23, 1986 [ES] Spain ..... 555270

[51] Int. Cl.[4] ..... B05B 7/00

[52] U.S. Cl. ..... 239/307; 329/239; 427/426

[58] Field of Search ..... 239/304, 307, 329, 418; 427/426

[56] References Cited

U.S. PATENT DOCUMENTS 4,204,644 5/1980 Kozuka ..... 239/418

*Primary Examiner*—Douglas C. Butler
*Assistant Examiner*—C. Trainor
*Attorney, Agent, or Firm*—Holman & Stern

[57] ABSTRACT

The invention is a color dosification and application machine. The machine has a rotary cutter that has a face plane and an internal plane. The machine also has a drive element for rotating the rotary cutter. On the rotary center are a plurality of blades. The blades emerge from the rotary cutter in an oblique position and form helical channels. The peripheral portion of the blades engage pigment bars during their rotation. The pigment bars are powdered and the powder is transported down the helical channel formed by the blades. At the central, terminal portion of the helical channel, the powder enters a needle through which gas and fluid pass. The gas and fluid passing through the needle mix with the powdered pigment and the mixture is sprayed through a nozzle.

7 Claims, 1 Drawing Sheet

COLOR DOSIFICATION/APPLICAION MACHINE

The invention defined in this specification and the attached drawings is a machine for the dosification and application of colors which is able to provide a color marking on the basis of pigments pulverized from a compressed powder based bar. The machine may be programmed with a computer to provide instantaneous color change by mixing two or more of a variety of colors. According to the type of pigments used, it may be necessary to fix the color marking at the moment when it is produced, using a chemical such as lacquer or any other of similar characteristics. It must be pointed out that both the powder pigment marking and the fixative are produced in pulverized form, using the air as the carrier.

With the introduction of powder based pigment blocks, that are preferably cylindrical in shape with some type of agglutinate, arranged behind a circular cutter whose rotation produces aspiration towards the center, the cutter powders the bars and, with the suction air current and the mechanical impulsion of the blades, sets up a blast of air and pigment outwards from the center. The cutter is housed inside an enclosure which has a port in the center from which there is a pressurized escape passage allowing for the blast of pigment and air.

The mechanism can contain as many sticks of color as will fit on the periphery of the cutter; however, the three primary colors with white and black may be sufficient for the function for which it has been created. The bars of color are pulverized as they advance into the rotary cutter, and the powder is released and carried inwards. The bars are moved by motors which may be of the stepping type, through speed reduction gears, and the speed of these motors controlled by a computer with an intervening interface. The computer program controls the dosification of the pigment such that at each speed for each motor, a quantity of primary color emerges plus the white and black so that the resulting color at any time is the mixture of all of these.

If, in addition, this nozzle is moved through three dimensions with a suitable mechanical structure, and its movement is controlled by three stepping motors, using the computer program, we will be able to create a color and movement which has been programmed. In other words, we will be able to create an image which is thus recorded in some type of computer memory, e.g. a cassette tape, and can be reproduced without limit, when the jet meets a fixed material support of any type.

This means that an autonomous color marking can be obtained, or, at the same time, it can be fixed with a chemical product or by any other known means. The color and fixative can be joined in many ways, broadly divided into two categories—internally and externally.

In the former, the air emerges from a fine nozzle which creates suction or negative pressure, internally aspirating the fixative liquid or agglutinant liquid, and externally aspirating the color in pigment form from the cutter. In addition, there is an internal liquid dosification needle. In the other category, the liquid and the powder are brought together in two separate parts of a blast of air created by the suction, mixing and pulverizing the two components, pigment and fixative; the input of fixative can be controlled by means of a needle with a back-and-forth movement such that the amount of liquid can be dosed as required.

Independently, it is possible to use only thr powder and fix it using other procedures, e.g. by using pigments which are sufficiently fatty so as to fix the powder themselves, or by previously wetting the paper along the route on which the pigment is to be subsequently projected, with suction from behind the paper so that the paper acts as a filter, projecting the powder onto a warm wax or providing a positive electrical discharge at the jet outlet in which the medium to be painted is grounded, so that each positively charged particle of the pigment will seek its negative medium or cathode. Likewise, any other method may be used to fix the pulverized pigment.

With this system, it is possible to measure the color and control the path so that all types of algebraic operations can be carried out with precision, with representation of the results in color, i.e. with a color assigned to each number, and with color representation of functions; according to the type of fixative, the color will be left with a different vibration.

In the light of the foregoing, and given the qualities of newness and practical utility of the color dosification and application machine which is the subject of this invention, it is believed to have sufficient basis for obtaining the privilege of exclusivity sought in respect of its manufacture and sale by the holders in Spain, as a result of this registration of which they avail themselves.

The color dosification and application system using the machine to which we are referring has multiple applications at the industrial level, offering particular interest in the ceramic industries for the decoration of slabs and tiles, in the pharmaceutical and chemical industries, for the reproduction of works of art, for a variety of artistic representations and for other applications not specified here.

For a better understanding of the general characteristics set out above, a page of drawings is attached which shows, in graphic form, a practical design for the color dosification-application machine which is the object of this application for registration. It must be pointed out that, given the predominantly informative nature of the drawings, the figures set out there must be examined using the very broadest criteria and without limitation whatsoever.

Figure 5:
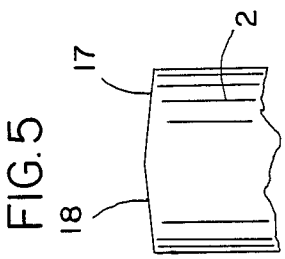
FIG. 5 is a scaled-up detail of the end of one of the pigment bars, showing the slightly conical form with which the cut takes place, preventing the material from hardening as the result of a head-on approach.

To assist in the location of the different elements making up this machine for the dosification and application of colors, numbered annotations have been incorporated into the figures on the attached page of drawings, related to the description given by way of continuation of their characteristics and functions. The rotary cutter (1) acts directly on the bars of pigment (2) which may be of any color, including black and white, and all of the pigment bars are located facing the internal plane of the cutter (1) in an equidistant and peripheral arrangement. They are all operated by the respective stepping motors (3) which are fitted with gear boxes, so as to cause the pigment bars to impinge upon the center of the cutter (1) with the needle (12) which is a fluid dosification element acting according to the positioner motor (4) to control the flow of liquid inwards at (point) 5. The air from the compressor enters at point (6) while the cutter (1) is turned by a pulley assembly (7) which is axially backed onto the cutter and driven by a belt. The belt can be turned by a turbine using air from the compressor. A gear wheel (7'), with the pertinent transmission can also be used in place of the pulley assembly (7).

All the mechanical components making up the color dosification-application machine which is the subject of this invention are controlled by a computer (9) connected to an interface (8), which may incorporate other elements such as the TV monitor (10), the cassette recorder (11), the artificial display control (13) or the remote telephone connection (14) which supply data to the computer (9). For its part, the computer controls the motors and elements of the machine as a whole in an orderly manner so as to obtain the function required.

Figure 6:
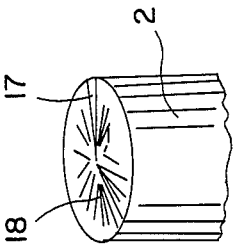
FIG. 6 is also a scaled-up view, in perspective, of the end of one of the pigment bars, showing the cut cross-section being done by the cutter; the part released is converted into color powder and directed by the cutter itself to a pressurized air outlet duct fed from a compressor for application with a fixative medium.
Figure 1:
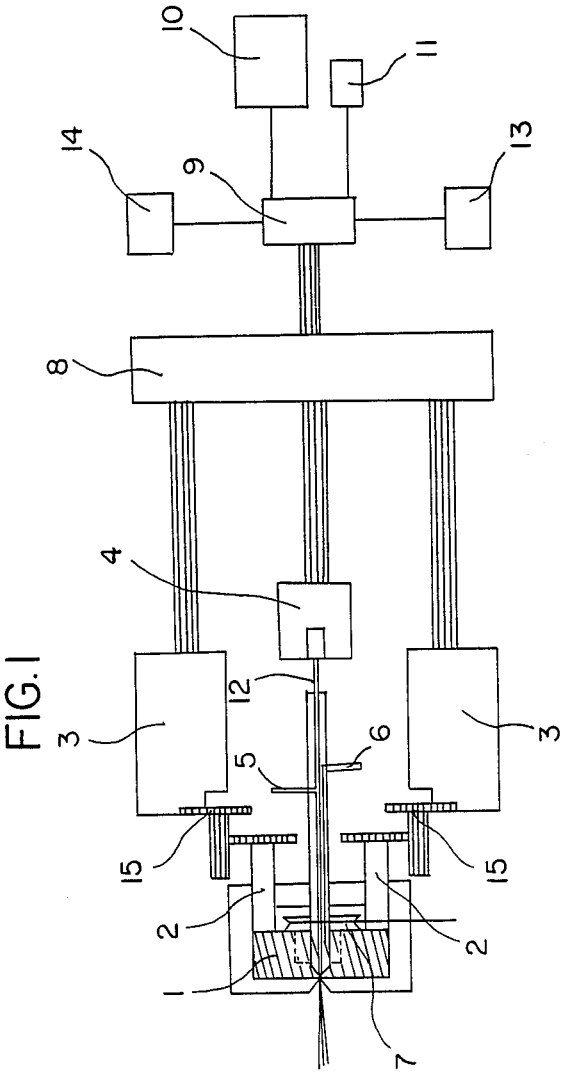
FIG. 1 is a diagrammatic projection of the color dosification-application machine operated by computer, programmed to run a group of stepping motors with gear box for moving the pigment bars forward; there is a needle positioner and flow control motor and a cutter for the release of the pigments from the bars for their application.
Figure 4:
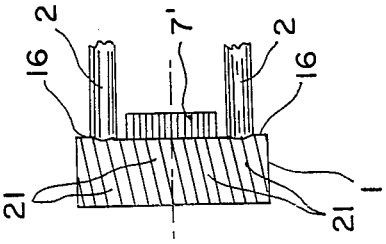
FIG. 4 is a side or profile view of the cutter and protruding axial pinion which turns it, showing the cutting blades emerging slightly and inclined along the internal plane; when they turn in combination with the rotation and movement forward of the bars of pigment, an inclined cut takes place to release powder or part of the pigment.
Figure 3:
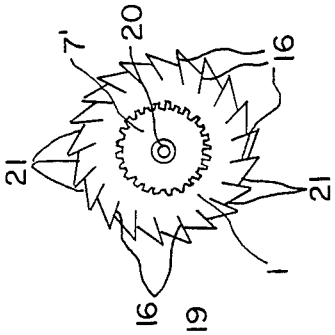
FIG. 3 is an internal frontal view of the cutter showing, in the first place, a gear-wheel or pulley transmission with the protruding peripheral blades for impinging on the color pigment bars.
Figure 2:
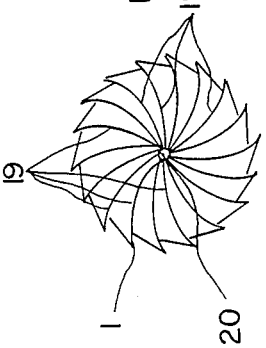
FIG. 2 is an external frontal view of the cutter along the channels for the movements of the pigment powder to the central opening for application on a surface, in programmed form.

The pigment bars (2) are turned and advanced by means of transmission (15). The pigment bars press on the cutting edge (16) of the cutter (1) at a slight incline so that the consumption or removal of the material from the bars (2) is carried out in layer form (17) of a slightly triangular type from the center of the bar (2) towards the periphery (FIG. 6); the ends of the bars (2) become conical in shape (18) with a large angle at the tip (FIG. 5), thus preventing the cutting edges (16) of the cutter (1) from meeting the bars head-on, so that the material does not harden or compact.

The external plane of the cutter (1) has a number of helical ducts (19) which run to the central opening or nozzle (20); the material removed from the pigment bars (2) and converted into powder, flows through the peripheral channels (21) to the ducts (19) and the central nozzle (20) by means of the pressurized air and liquid. The material is projected in order to complete the pigmentation function and the colors are applied in dosed form.

Having broadly described each and every one of the parts making up the color dosification and application machine which is the subject of this invention, it remains only to point out that the different parts may be produced in a variety of materials, sizes and shapes and, likewise, that variations of a constructional type may be introduced to the design on the basis of practical experience, provided that these factors do not alter the essential points of the apparatus which is the subject of this Registration of Letters Patent.

We claim:

1. A color dosification and application machine comprising:
   - a rotary cutter, said rotary cutter having a face plane and an internal plane;
   - a drive element for rotating said rotary cutter; and
   - a plurality of blades, each of said blades emerging in an oblique position from said rotary cutter and forming a helical channel in said rotary cutter, said helical channel being between said face plane and said internal plane whereby color pigment bars are engaged during said rotating of said rotary cutter at a periphery of said blades and are converted into powder, said powder being transported from said periphery of said blades to an axially positioned needle having a central nozzle wherein said powder is mixed with pressurized air and fluid emerging through said nozzle.

2. The color dosification and application machine of claim 1 wherein:
   - a computer means coordinates said drive element for rotating said rotary cutter and a means for moving said pigment bars into engagement with said blades.

3. The color dosification and application machine of claim 2 wherein:
   - said drive element includes stepping motors for rotating reduction gears; and
   - said reduction gears rotate said rotary cutter.

4. The color dosification and application machine of claim 3 wherein:
   - said reduction gears rotate a pulley means centrally mounted in said internal plane of said rotary cutter.

5. The color dosification and application machine of claim 3 wherein:
   - said reduction gears rotate a geared wheel centrally mounted in said internal plane of said rotary cutter.

6. The color dosification and application machine of claim 1 wherein:
   - said rotary cutter is in an enclosure; and
   - said rotating of said rotary cutter forces air along said helical channel of each of said blades into said needle.

7. The color dosification and application machine of claim 1 wherein:
   - said pigment bars engage said blades on said internal plane of said rotary cutter.

* * * * *